US007901064B2

(12) United States Patent
Urayama et al.

(10) Patent No.: US 7,901,064 B2
(45) Date of Patent: Mar. 8, 2011

(54) INK JET RECORDING HEAD WITH INK FILTER FORMED OF A PLURALITY OF STACKED FILMS

(75) Inventors: Yoshinobu Urayama, Kanagawa (JP); Kenji Fujii, Kanagawa (JP); Masaki Ohsumi, Kanagawa (JP); Jun Yamamuro, Kanagawa (JP); Hiroyuki Murayama, Kanagawa (JP); Yoshinori Tagawa, Kanagawa (JP); Shuji Koyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1080 days.

(21) Appl. No.: 11/625,537

(22) Filed: Jan. 22, 2007

(65) Prior Publication Data

US 2007/0176990 A1 Aug. 2, 2007

(30) Foreign Application Priority Data

Feb. 2, 2006 (JP) ..... 2006-025893

(51) Int. Cl.
*B41J 2/175* (2006.01)
*B41J 2/05* (2006.01)
*B41J 2/045* (2006.01)

(52) U.S. Cl. ..... 347/93; 347/65; 347/71

(58) Field of Classification Search ..... 347/93, 347/20, 40, 44, 45, 46, 47, 65, 71, 56, 61–63, 347/92; 29/890.1, 611
See application file for complete search history.

(56) References Cited

U.S. PATENT DOCUMENTS

| | | | | |
|---|---|---|---|---|
| 5,204,690 | A * | 4/1993 | Lorenze et al. | 347/93 |
| 5,489,930 | A * | 2/1996 | Anderson | 347/71 |
| 5,610,645 | A * | 3/1997 | Moore et al. | 347/93 |
| 5,933,163 | A | 8/1999 | Koizumi et al. | 347/42 |
| 6,139,761 | A | 10/2000 | Ohkuma | |
| 6,168,254 | B1 * | 1/2001 | Karita et al. | 347/20 |
| 6,180,018 | B1 | 1/2001 | Miyagawa et al. | 216/27 |
| 6,264,309 | B1 * | 7/2001 | Sullivan | 347/63 |
| 6,582,064 | B2 * | 6/2003 | Cruz-Uribe et al. | 347/63 |
| 6,659,588 | B2 | 12/2003 | Ikegame et al. | 347/40 |
| 6,779,877 | B2 * | 8/2004 | Andrews | 347/65 |
| 6,877,964 | B2 * | 4/2005 | Burns et al. | 417/410.1 |
| 6,986,571 | B2 * | 1/2006 | Dudenhoefer et al. | 347/93 |
| 7,244,020 | B2 * | 7/2007 | Chikamoto | 347/93 |
| 7,287,847 | B2 * | 10/2007 | Fujii et al. | 347/93 |
| 2005/0184003 | A1 * | 8/2005 | Rodgers et al. | 210/321.75 |
| 2007/0176990 | A1 | 8/2007 | Urayama et al. | 347/93 |
| 2007/0178248 | A1 | 8/2007 | Ohsumi et al. | 427/555 |
| 2007/0207414 | A1 | 9/2007 | Murayama et al. | 430/311 |
| 2007/0289942 | A1 | 12/2007 | Fujii et al. | 126/27 |

FOREIGN PATENT DOCUMENTS

JP 2000-94700 4/2000

* cited by examiner

*Primary Examiner* — Manish S Shah
(74) *Attorney, Agent, or Firm* — Fitzpatrick, Cella, Harper & Scinto

(57) ABSTRACT

An ink jet recording head includes: a substrate; a plurality of ink discharge ports formed to a front face side of the substrate, and a plurality of ink flow paths communicating with the ink discharge ports; an ink supply opening extending through the substrate and communicating with the plurality of ink flow paths; and a filter formed in an opening portion of the ink supply opening arranged in the front face side of the substrate, the filter being constituted of two or more stacked films having formed therein a plurality of opening portions. In this case, the stacked films are arranged with a spacing therebetween.

5 Claims, 7 Drawing Sheets

INK JET RECORDING HEAD WITH INK FILTER FORMED OF A PLURALITY OF STACKED FILMS

BACKGROUND OF THE INVENTION

1. Field of the Invention

The present invention relates to an ink jet recording head and manufacturing method thereof, and more particularly to an ink jet recording head provided with a filter preventing foreign matters from entering an ink flow path.

2. Description of the Related Art

The structure of a typical ink jet recording head will be described with reference to FIG. 8A. In the ink jet recording head illustrated in FIG. 8B, ink is discharged in an orthogonal direction relative to a discharge energy generating element 50 which generates energy for discharging ink.

Recently, in order to implement further downsizing and higher density of ink jet recording heads, there has been proposed a method of incorporating by use of a semiconductor manufacturing technique an electrical control circuit for driving the discharge energy generating elements into a substrate. The ink jet recording head illustrated in FIG. 8A is one manufactured by such technique. More specifically, in the substrate 51 illustrated in FIG. 8A, there are also incorporated an electrical control circuit (not illustrated) for driving the discharge energy generating elements 50, and other components.

Further, in order to supply ink to a plurality of ink discharge ports 52 through which ink is discharged, an ink flow path 53 is formed for each ink discharge port 52; and these ink flow paths 53 communicate with a common ink supply opening 54 formed in the substrate 51. The ink supply opening 54 extends through the substrate 51; and ink is supplied from the rear face side of the substrate 51 through the ink supply opening 54 to each ink flow path 53. When an Si substrate is used as the substrate 51, the ink supply opening 54 can be formed using an Si anisotropic etching technique (refer to U.S. Pat. No. 6,139,761).

Here, factors of reliability required of an ink jet recording head include one that printing failure ascribable to non-discharging (ink is not discharged from the particular nozzle) caused by nozzle blockage hardly occurs. As the typical reasons for occurrence of such printing failure, there are thought to be cutoff, etc., of ink to be supplied to the interior of the nozzle caused by solidification and dust entering the nozzle. Further, details of the latter reason are roughly classified as follows: (1) dust and foreign matters enter the nozzle during the ink jet recording head manufacturing process; or (2) dust and foreign matters come from the outside into the nozzle after the ink jet recording head manufacturing (during its use).

Particularly, regarding concern about the above reason (2), it is highly likely that when the ink supply system has a configuration separable from the ink jet recording head, dust and foreign matters come in through a connecting portion therebetween. As one measure against such reason, for example, there has been used a method of arranging a filter in the vicinity of the ink supply opening of ink jet recording head. However, in the case where a filter is arranged in the ink supply opening, when the filter is manufactured and mounted separately from the ink jet recording head, this is not always satisfactory in terms of manufacturing cost, component cost, quality control, connection reliability between components, or the like, resulting in requests for further improvement.

As an invention for solving these problems, Japanese Patent Application Laid-Open No. 2000-94700 has disclosed a technique of using an anisotropic etching mask for forming an ink supply opening in a substrate (Si substrate) to thereby form a filter. More specifically, as illustrated in FIG. 8A, a filter pattern is formed directly in a thermally-oxidized film layer 55 being the above anisotropic etching mask, and when the ink supply opening 54 is formed by anisotropic etching, a filter 56 is simultaneously formed using the thermally-oxidized film layer 55 which is an etching-resistant layer.

In the ink jet recording head disclosed in Japanese Patent Application Laid-Open No. 2000-94700, the filter 56 is arranged in the substrate rear face side opening portion of the ink supply opening 54; thus the filter 56 is exposed to the outside.

Consequently, during the post-process of forming the discharge energy generating element 50, the filter is exposed to various liquids, or when conveyed within the semiconductor manufacturing apparatus, minor flaws occur therein. Also, when the ink jet recording head is mounted, it is highly likely that minor flaws occur in the filter 56. As a result, for example, a pinhole 57 as illustrated in FIG. 8B occurs in the filter 56, thus reducing production yield or deteriorating filter performance.

SUMMARY OF THE INVENTION

An object of the present invention is to make it possible to manufacture at low cost and high production yield an ink jet recording head provided with a filter capable of preventing dust or foreign matters from coming in.

According to an aspect of the present invention, an ink jet recording head comprises: a substrate; a plurality of ink discharge ports formed at a front face side of the substrate, and a plurality of ink flow paths communicating with the ink discharge ports; an ink supply opening extending through the substrate and communicating with the plurality of ink flow paths; and a filter formed in an opening portion of the ink supply opening arranged at the front face side of the substrate, the filter being constituted of two or more stacked films having formed therein a plurality of opening portions, wherein the stacked films are arranged with a spacing therebetween.

According to an embodiment of the present invention, a filter for preventing foreign matters from entering the ink flow path is formed to the substrate front face side opening portion of the ink supply opening. Therefore, the filter is not exposed to the outside of the substrate, and flaws rarely occur in the filter during the manufacturing process or the process of mounting it in a recording device.

Further features of the present invention will become apparent from the following description of exemplary embodiments with reference to the attached drawings.

DESCRIPTION OF THE EMBODIMENTS

Figure 1:
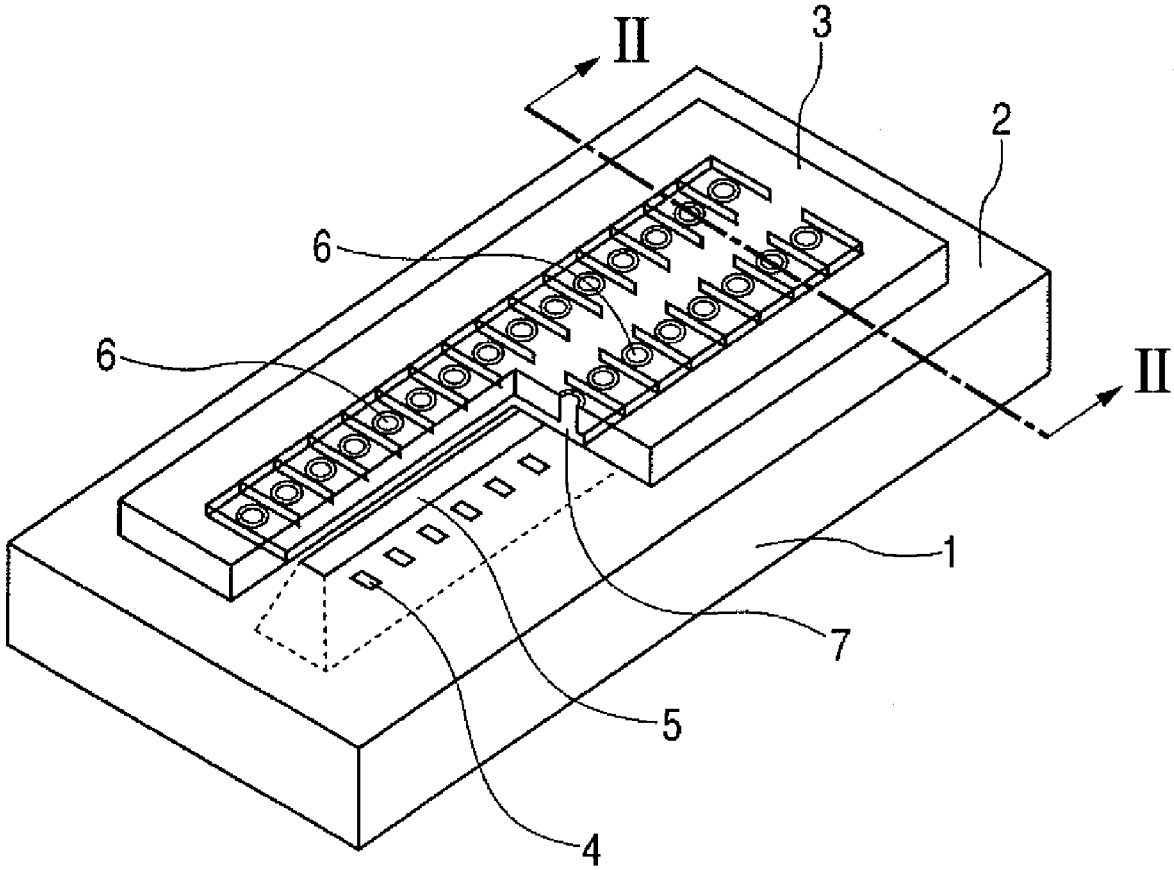
FIG. 1 is a schematic perspective view illustrating an exemplary ink jet recording head according to an embodiment of the present invention.
Figure 2:
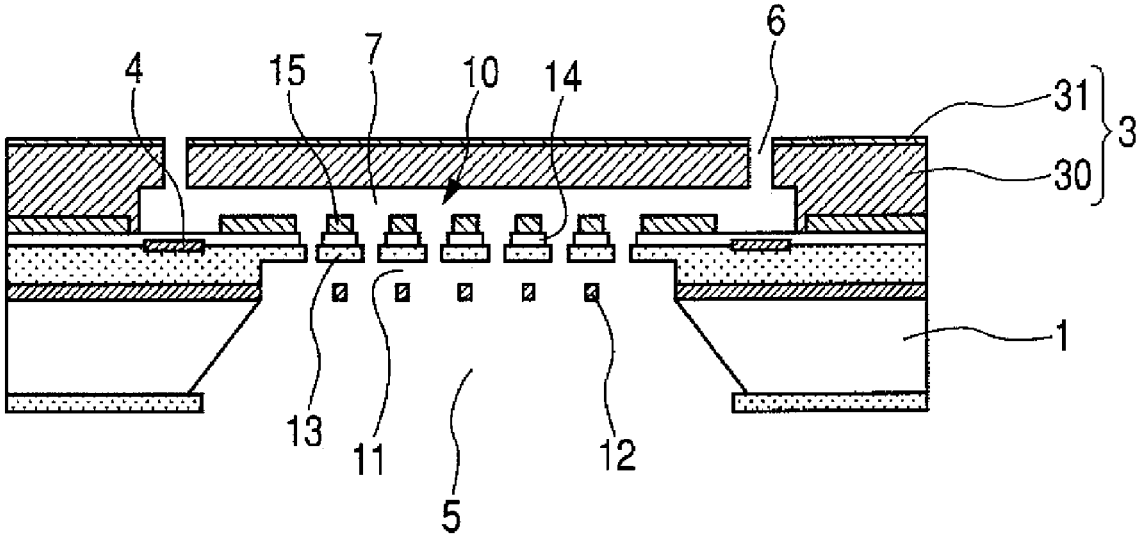
FIG. 2 is a cross-sectional view of the ink jet recording head illustrated in FIG. 1 taken along the line II-II.

Embodiments of the present invention will be described with reference to the drawings. FIG. 1 illustrates a schematic perspective view of an ink jet recording head according to the present embodiment; and FIG. 2 illustrates a cross-sectional view of the ink jet recording head illustrated in FIG. 1 taken along the line II-II. This ink jet recording head includes an Si substrate 1 and an orifice plate 3 formed on a front face 2 of the Si substrate 1.

On the front face 2 of the Si substrate 1, there are formed in parallel two lines of discharge energy generating elements each constituted of a plurality of discharge energy generating elements 4 arranged at a predetermined pitch. Though not illustrated in the drawings, in the Si substrate 1, there are formed not only the discharge energy generating elements 4 but also various wires, drive elements for driving the discharge energy generating elements 4, and the like.

In the Si substrate 1, there is further formed an ink supply opening 5 extending through the front and rear faces of the Si substrate 1. The ink supply opening 5 is formed by anisotropic etching using a strong alkaline solution such as TMAH or KOH, with a thermally-oxidized film layer used as a mask.

The orifice plate 3 is constituted of a coated photosensitive resin layer 30 and a water-repellent layer 31. In the orifice plate 3, there are formed ink discharge ports 6 which open immediately above each discharge energy generating element 4, and an ink flow path 7 allowing the ink supply opening 5 and each ink discharge port 6 to communicate with each other.

Further, a filter 10 for preventing dust and foreign matters from entering the ink flow path 7 is formed to the substrate front face side opening portion of the ink supply opening 5. This filter 10 is a multilayer filter including a first filter layer 12 and a second filter layer 13 stacked via a void portion 11, and a first filter reinforcement layer 14 and a second filter reinforcement layer 15 stacked on the second filter layer 13.

Figure 3:
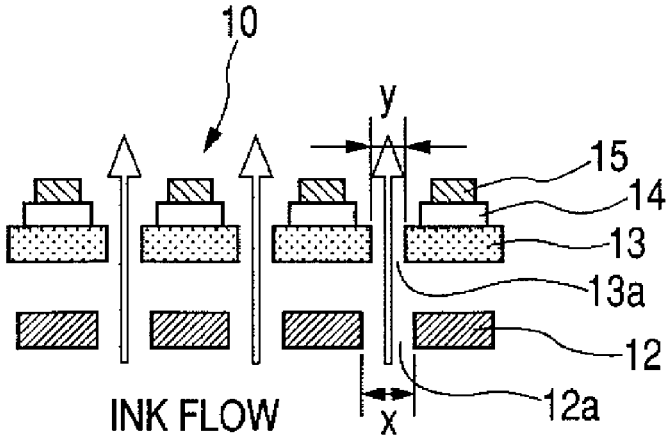
FIG. 3 is an enlarged view of the filter illustrated in FIG. 2.

FIG. 3 illustrates an enlarged view of the filter 10. In the first filter layer 12, there are formed a plurality of fine opening portions 12*a*; and in the second filter layer 13, there are formed a plurality of fine opening portions 13*a*. Here, when the diameter of each fine opening portion 12*a* is x and the diameter of each fine opening portion 13*a* is y, a relationship x>y holds. Also, the central position of the fine opening portion 12*a* agrees with that of the fine opening portions 13*a*. There is concern that, when ink moves past the fine opening portions 12*a* and 13*a* of the two filter layers 12 and 13, pressure loss (flow resistance) occurs, adversely affecting ink supply performance. However, when the central position of the fine opening portion 12*a* agrees (aligns) with that of the fine opening portions 13*a*, the above pressure loss is suppressed to a minimum. The structure and manufacturing method of the filter 10 will be described later.

The ink jet recording head according to the present embodiment is mounted so that the orifice plate 3 faces the recording plane of a recording medium to be recorded on. Then, when pressure generated by the discharge energy generating element 4 is applied to ink (liquid) which is filled via the ink supply opening 5 into the ink flow path 7, ink droplet is discharged from the ink discharge port 6 and attached to the recording medium to be recorded on, whereby printing is performed. According to the multilayer filter configuration of the present embodiment, even when foreign matters are picked up by the first filter 12, since a sufficient opening diameter (x) and void portion 11 are provided therein, a necessary and sufficient quantity of ink can be supplied.

This ink jet recording head can be mounted in a facsimile machine having a printer, copier and communication system, an apparatus having a printer unit such as a word processor, or further an industrial recording apparatus combined with various types of processing apparatuses in a composite manner. When this ink jet recording head is used, recording can be made on various types of recording media to be recorded on, such as paper, thread, fiber, cloth, leather, metal, plastic, glass, wood or ceramics. It is noted that, in the embodiments of the present invention, the term "recording" means not only a case where meaningful images such as characters and figures are formed on recording media to be recorded on, but also a case where images such as a pattern having no meaning are formed thereon.

First Embodiment

Examples of an ink jet recording head according to embodiments of the present invention will be described below. FIGS. 4 to 6 are schematic cross-sectional views illustrating a basic process of fabricating an ink jet recording head according to an embodiment of the present invention. The Si substrate 1 illustrated in the drawings has crystal orientation <100>, but the crystal orientation of the Si substrate 1 is not limited to a particular crystal orientation.

Figure 4A:
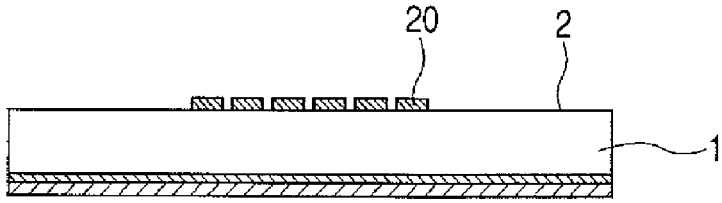
FIGS. 4A, 4B, 4C and 4D are schematic cross-sectional views illustrating part of a basic process of fabricating the ink jet recording head illustrated in FIG. 1.
Figure 4B:
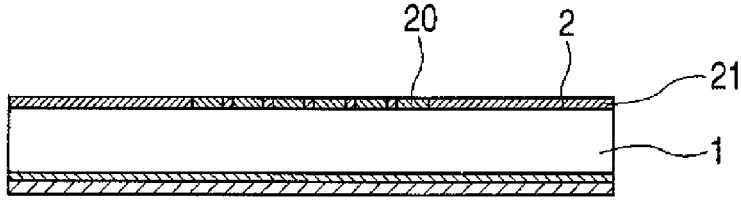
Figure 4C:
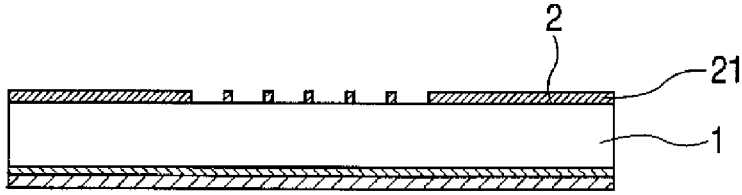

First, as illustrated in FIG. 4A, an Si nitride film 20 is formed on a front face 2 of the Si substrate 1; and the Si nitride film 20 thus formed is patterned corresponding to a pattern of the first filter layer 12. Thereafter, as illustrated in FIG. 4B, a thermally-oxidized film layer (Si oxidized film) 21 which is an insulating film is formed on the front face 2 of the Si substrate 1. Subsequently, as illustrated in FIG. 4C, the Si nitride film 20 is completely removed, whereby fine opening portions 12*a* (FIG. 3) are formed to the Si oxidized film 21.

Figure 4D:
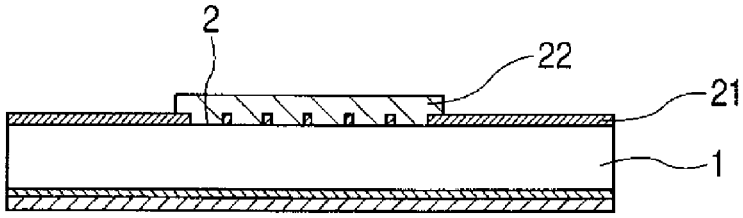

Subsequently, as illustrated in FIG. 4D, there is formed a sacrifice layer 22 attaching firmly to the front face 2 of the Si substrate 1 and to the Si oxidized film 21. More specifically, the sacrifice layer 22 is formed through each process of photoresist coating, exposure, development, etching and photoresist removal. When these processes are performed, the fine opening portions 12*a* previously formed are once filled up with the sacrifice layer 22. In the present embodiment, the sacrifice layer 22 was formed using Al, but this is not limited thereto as long as a material is used which dissolves in strong alkaline solution, such as TMAH or KOH, used as an anisotropic etching solution when the ink supply opening 5 (FIG. 2) is later formed.

Figure 5A:
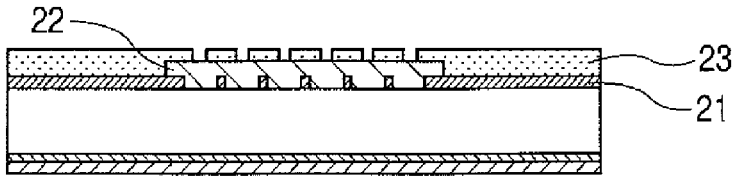
FIGS. 5A, 5B, 5C and 5D are schematic cross-sectional views illustrating part of the basic process of fabricating the ink jet recording head illustrated in FIG. 1.

Subsequently, as illustrated in FIG. 5A, there is formed a thermally-oxidized film (Si oxidized film) 23 attaching firmly to the sacrifice layer 22 and to the Si oxidized film 21 positioned in the outer side thereof. Further, on the Si oxidized film 23 thus formed, by use of processes of exposure and development, there is formed an etching mask (not illustrated) patterned after the second filter layer 13 illustrated in FIG. 2, and then each process of etching and photoresist removal is performed.

Figure 5B:
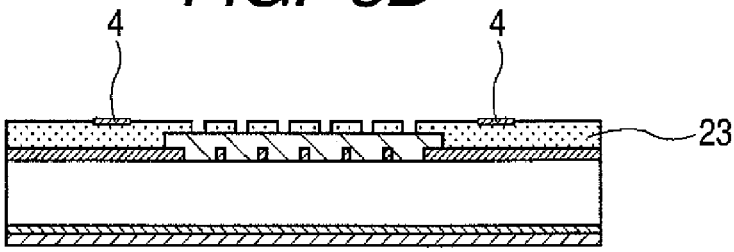

Subsequently, as illustrated in FIG. 5B, discharge energy generating elements 4 are formed on the Si oxidized film 23. Though not illustrated in FIG. 5B, on the Si substrate 1, there are also formed wires, drive elements for driving the discharge energy generating elements 4, and the like.

Figure 5C:
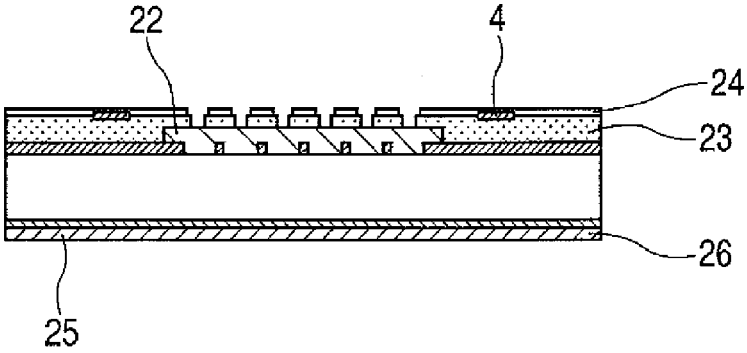

Subsequently, there is formed an Si nitride film 24 attaching firmly to the sacrifice layer 22, the Si oxidized film 23 and the discharge energy generating elements 4. Further, spin coating with photoresist is performed on the Si nitride film 24 formed, and processes of exposure and development are performed, whereby an etching mask for forming the first filter reinforcement layer 14 illustrated in FIG. 2 is formed. Thereafter, as illustrated in FIG. 5C, processes of etching and photoresist removal are sequentially performed.

Figure 5D:
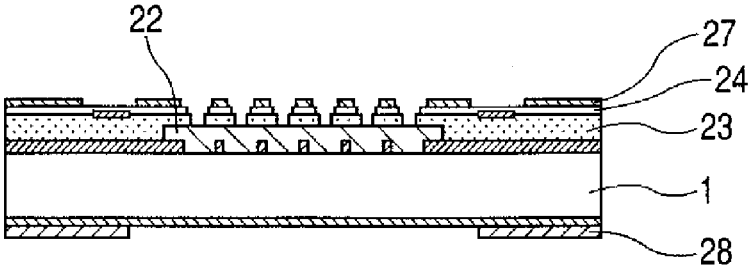

Subsequently, a Poly-Si layer 26 (FIG. 5C) formed on a rear face 25 of the Si substrate 1 is completely removed by dry etching, etc. Thereafter, as illustrated in FIG. 5D, on the front face 2 side of the Si substrate 1, there is formed a thermoplastic resin layer 27 which firmly attaches to the sacrifice layer 22, the Si oxidized film 23 and the Si nitride film 24. Also, on the rear face 25 side of the Si substrate 1, there is formed a thermoplastic resin layer 28. In the present embodiment, thermoplastic polyether amide was used as the thermoplastic resin layers 27 and 28, but this is not limited thereto as long as a material is used which has resistance to ink and strong alkaline solution such as TMAH and KOH. After the thermoplastic resin layers 27 and 28 have been formed, spin coating with photoresist is performed, and processes of exposure and development are performed, whereby an etching mask for forming the second filter reinforcement layer 15 illustrated in FIG. 2 is formed. Thereafter, processes of etching and photoresist removal are sequentially performed.

Figure 6A:
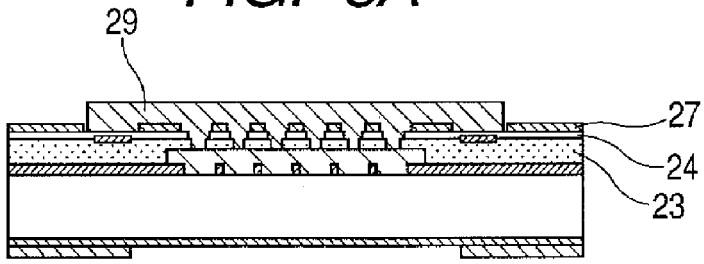
FIGS. 6A, 6B, 6C and 6D are schematic cross-sectional views illustrating part of the basic process of fabricating the ink jet recording head illustrated in FIG. 1.

Subsequently, as illustrated in FIG. 6A, there is performed spin coating with a soluble resin layer 29 which firmly attaches to the Si oxidized film 23, the Si nitride film 24 and the thermoplastic resin layer 27.

Figure 6B:
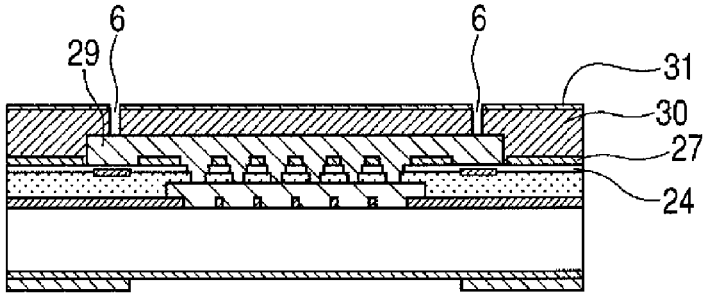

Subsequently, as illustrated in FIG. 6B, spin coating with a coated photosensitive resin layer 30 is performed so that the layer 30 attaches firmly to the soluble resin layer 29, and those parts of the Si nitride film 24 and thermoplastic resin layer 27 which are not covered with the soluble resin layer 29, and then coating with a water-repellent layer 31 is performed on the coated photosensitive resin layer 30. Thereafter, ink discharge ports 6 are patterned.

Figure 6C:
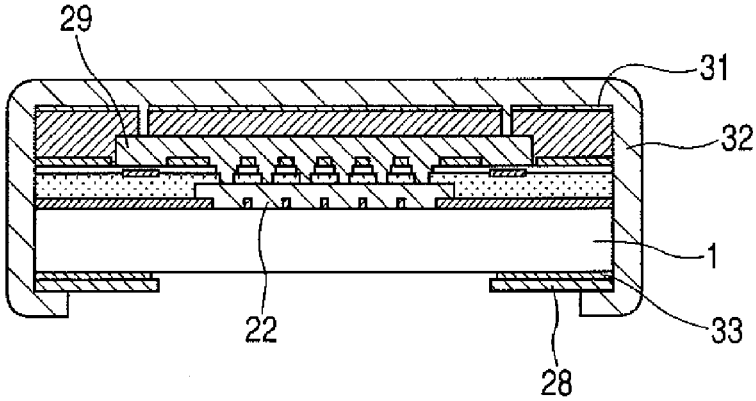

Subsequently, as illustrated in FIG. 6C, the water-repellent layer 31, the soluble resin layer 29 and the side face of the Si substrate 1 are coated with a protective layer 32 by spin coating or the like. The protective layer 32 is not limited as long as a material is used which has resistance to strong alkaline solution such as TMAH and KOH and is capable of preventing deterioration of the water-repellent layer 31. After coating with the protective layer 32, the thermally-oxidized film layer 33 is etched with the thermoplastic resin layer 28 used as the etching mask, whereby a silicon surface of the Si substrate 1 which becomes the anisotropic etching initiation surface is exposed.

Figure 6D:
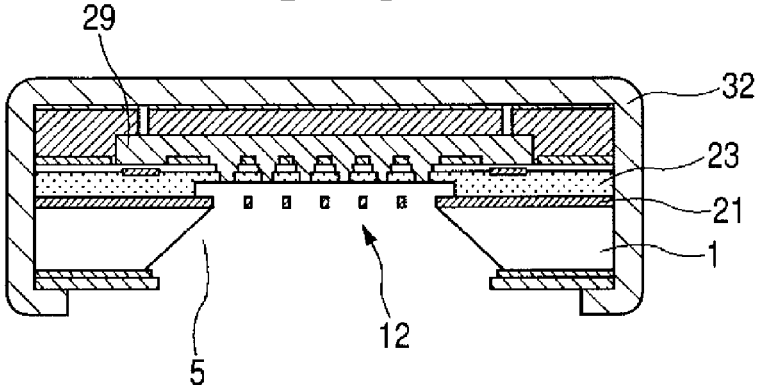

Subsequently, as illustrated in FIG. 6D, an ink supply opening 5 is formed in the Si substrate 1. This ink supply opening 5 is formed by anisotropic etching using strong alkaline solution such as TMAH or KOH. When this anisotropic etching is performed, the Si substrate 1 and the sacrifice layer 22 (FIG. 6C) dissolve in the etching solution. As a result, when the anisotropic etching is completed, a first filter layer 12 composed of a part of the Si oxidized film 21 is formed together with the ink supply opening 5.

Subsequently, after the protective layer 32 has been completely removed, Deep UV is irradiated on the entire surface from the water-repellent layer 31 side, and the soluble resin layer 29 is completely removed by a wet processing. As a result of completely removing the soluble resin layer 29, a second filter layer 13 illustrated in FIG. 2 is formed using a part of the Si oxidized film 23. Also, a first filter reinforcement layer 14 is formed using a part of the Si nitride film 24; and a second filter reinforcement layer 15 is formed using a part of the thermoplastic resin layer 27. In addition, an ink flow path 7 is also formed. From the drawings, it is evident that the second filter layer 13, the first filter reinforcement layer 14, the second filter reinforcement layer 15 and the ink flow path 7 are simultaneously formed when the soluble resin layer 29 is removed.

The Si substrate 1 formed by the above described processes is separated and cut with a dicing saw or the like, and is made into a chip, and electrical junction for allowing the discharge energy generating element 4 to be driven is made. Thereafter, a chip tank member for supplying ink is connected, whereby the main manufacturing process of the ink jet recording head is completed.

In the present embodiment, the first and second filter layers were formed using Si oxidized films. However, the material of the first and second filter layers is not limited to a particular one as long as a material is used which has resistance to ink and strong alkaline solution, such as TMAH and KOH, used as the anisotropic etching solution when the ink supply opening is formed. For example, instead of Si oxidized film, the first and second filter layers can also be formed using Si nitride film.

Also, in the present embodiment, the first filter reinforcement layer was formed using Si nitride film. However, the material of the first filter reinforcement layer is not limited as along as a material is used which has resistance to ink and strong alkaline solution such as TMAH and KOH.

In the present embodiment, the Si nitride film formed on the face of the Si substrate was patterned and then the thermally-oxidized film layer (Si oxidized film) was formed and thereafter the Si nitride film was removed, whereby the first filter layer was formed. However, the process of forming the first filter layer is not limited to the above one; for example, the first filter layer can also be formed by the following process. First, without forming the above Si nitride film, a thermally-oxidized film is formed on the face of the Si substrate, and then spin coating with photoresist is performed on the thermally-oxidized film. Subsequently, an etching mask for forming a pattern which becomes the first filter layer is formed and then a pattern which becomes the first filter layer is formed through processes of etching and photoresist removal.

Second Embodiment

Figure 7:
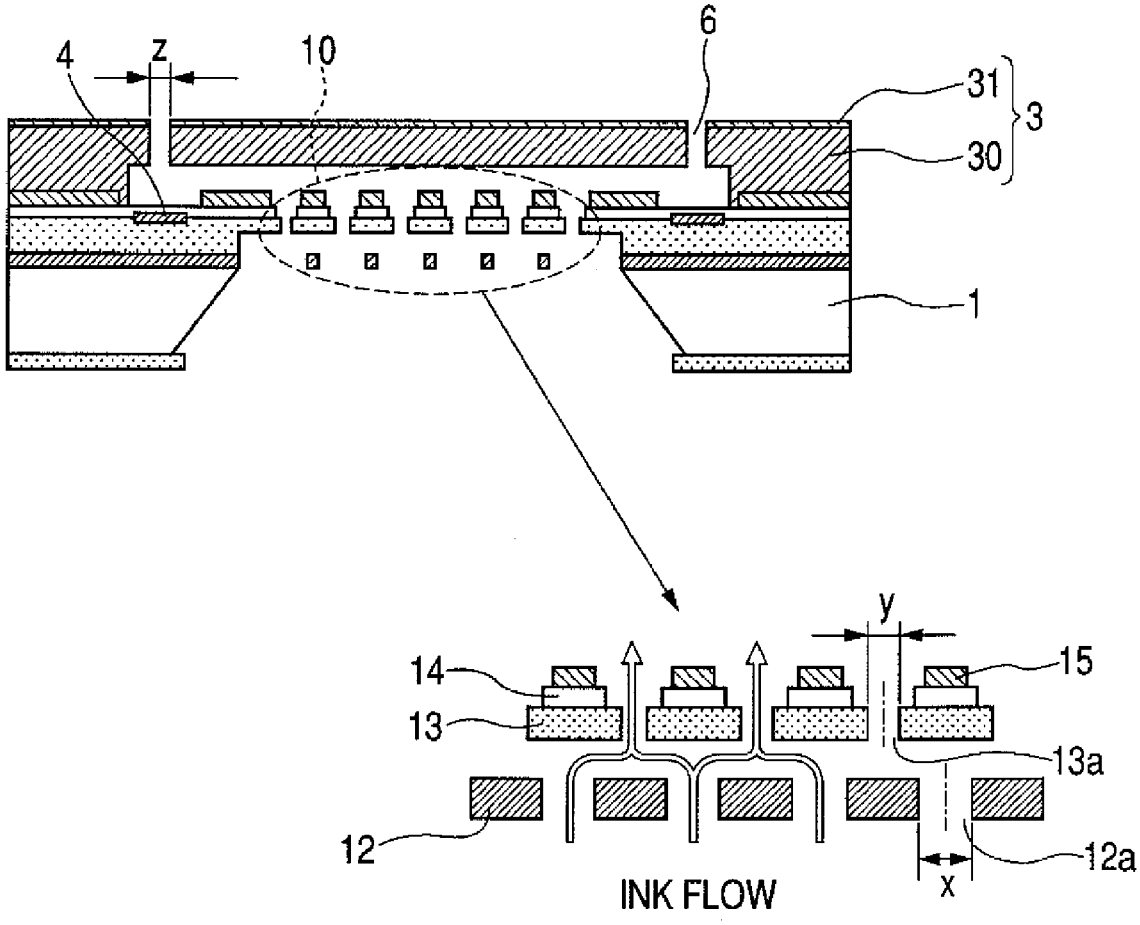
FIG. 7 is a schematic cross-sectional view illustrating another exemplary ink jet recording head according to an embodiment of the present invention.
Figure 8A:
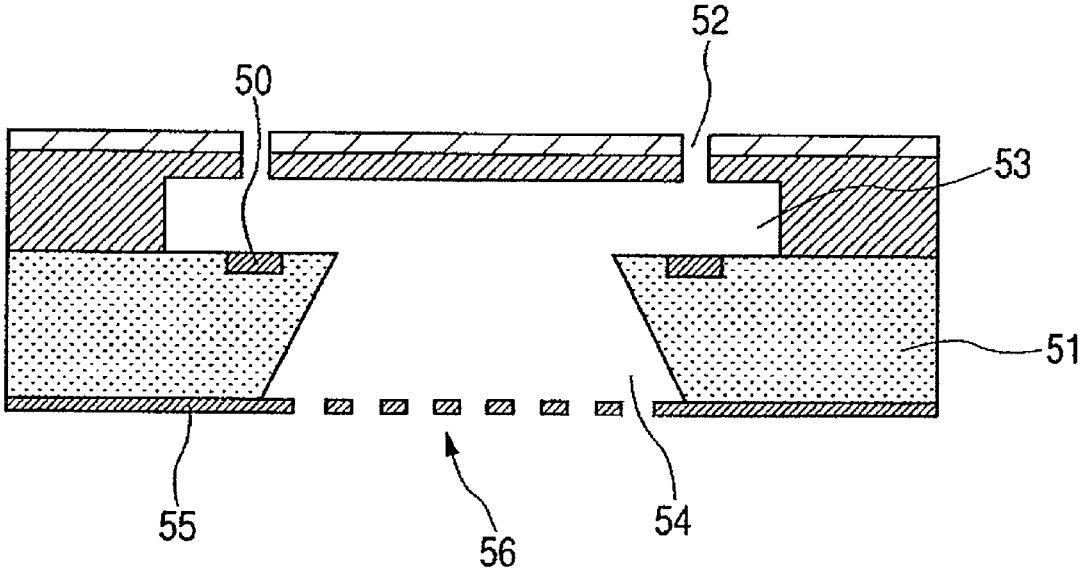
PRIOR ART FIG. 8A
FIGS. 8A and 8B are schematic cross-sectional views illustrating an exemplary ink jet recording head according to conventional art.
Figure 8B:
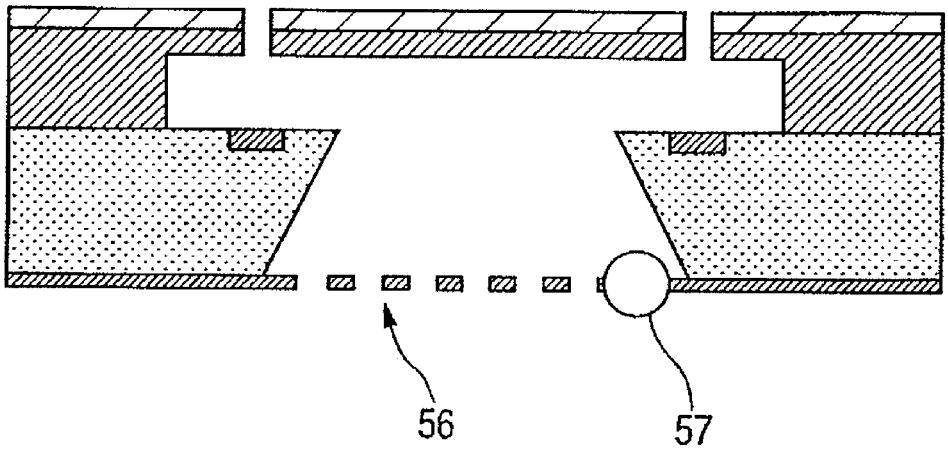
PRIOR ART FIG. 8B

In the first embodiment, there was described an example where the central position of the fine opening portion 12*a* of the first filter layer 12 is made to agree with that of the fine opening portion 13*a* of the second filter layer 13. However, as illustrated in FIG. 7, it is also possible that the central position of the fine opening portion 12*a* is displaced from that of the fine opening portion 13*a*. Also, in the example of FIG. 7, when the diameter of the fine opening portion 12*a* is x and the diameter of the fine opening portion 13*a* is y and the diameter of the ink discharge port 6 is z, then a relationship $x>y$, $z>y$ holds.

With certainty, when the central position of the fine opening portion 12*a* is displaced from that of the fine opening portion 13*a*, there is a tendency that pressure loss increases and thus ink supply performance deteriorates, compared to Embodiment 1. On the other hand, however, finer dust and foreign matters can be picked up, compared to Embodiment 1. Also, when small droplet is discharged, it is possible to ensure a certain degree of margin in supplying ink, whereas it is more likely that ink supply is cut off by blockage caused by dust and thus printing failure occurs. Accordingly, when prevention of printing failure has priority, it is effective that the central position of the fine opening portion 12*a* is displaced from that of the fine opening portion 13*a*.

As a method of implementing the configuration as illustrated in FIG. 7 with the central position of the fine opening portion 12*a* displaced from that of the fine opening portion 13*a* illustrated in FIG. 3, there is one in which the position of the fine opening portion 12*a* illustrated in FIG. 3 remains unchanged and the position of the fine opening portion 13*a* is made to move laterally from the position illustrated in FIG. 3. It is also possible that the position of the fine opening portion 13*a* remains unchanged and the position of the fine opening portion 12*a* is made to move laterally from the position illustrated in FIG. 3. Further, it is also possible that both the positions of the fine opening portion 12*a* and fine opening portion 13*a* are made to move laterally from those illustrated in FIG. 3.

As a method of moving the position of the fine opening portion 12*a* illustrated in FIG. 3 laterally from the position illustrated in FIG. 3, there is one in which the pattern forming position of the Si nitride film 20 illustrated in FIGS. 4A and 4B is changed and the position of holes formed to the Si oxidized film 5 is thereby changed. It is also possible that the etching position is changed when the Si oxidized film 5 is patterned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-025893, filed Feb. 2, 2006, which is hereby incorporated by reference herein in its entirety.

What is claimed is:

1. An ink jet recording head, comprising:

a substrate;

a plurality of ink discharge ports formed at a first face side of the substrate, and a plurality of ink flow paths communicating with the ink discharge ports;

an ink supply opening extending through the substrate and communicating with the plurality of ink flow paths; and a filter formed at an opening portion of the ink supply opening arranged in the first face side of the substrate, the filter being constituted of two or more stacked films having formed therein a plurality of opening portions, wherein the stacked films are arranged with respect to an ink flow direction with a spacing therebetween, if the diameter of each of the discharge ports is z, the diameter of each of first opening portions, which are formed in one of the films constituting the filter, the one film being closest to the first face side, is y, and the diameter of each of second opening portions, which are formed in another of the films constituting the filter, the other film being furthest from the first face side, is x, then $x>y$ and $z>y$.

2. The ink jet recording head according to claim 1, wherein at least one reinforcement layer is stacked on at least one layer of the films constituting the filter.

3. The ink jet recording head according to claim 2, wherein the at least one reinforcement layer is formed of a thermoplastic resin layer.

4. The ink jet recording head according to claim 1, wherein central positions of fine opening portions formed in each one of the films constituting the filter align in a liquid flow direction of the fine opening portions.

5. The ink jet recording head according to claim 1, wherein the films constituting the filter are Si oxidized films or Si nitride films.

* * * * *